US005403374A

United States Patent [19]

Kitagawa et al.

[11] Patent Number: 5,403,374

[45] Date of Patent: Apr. 4, 1995

[54] WATCH EXTERIOR PARTS AND MANUFACTURING METHOD THEREOF

[75] Inventors: Nobuyuki Kitagawa; Toshio Nomura, both of Hyogo; Yoichi Yaguchi, Tokyo; Hidehiro Uchiumi, Tokyo; Naoko Iwashimizu, Tokyo, all of Japan

[73] Assignees: Sumitomo Electric Industries, Ltd., Osaka; Namiki Precision Jewel Co., Ltd., Tokyo, both of Japan

[21] Appl. No.: 889,859

[22] Filed: May 28, 1992

[30] Foreign Application Priority Data

May 31, 1991 [JP] Japan ..... 3-155488

[51] Int. Cl.[6] ..... C22C 29/04; B22F 1/00

[52] U.S. Cl. ..... 75/238; 75/239; 75/240; 75/244; 75/246; 419/13; 419/14; 419/16; 419/18; 419/23; 419/33; 419/36; 419/38; 419/57; 419/60

[58] Field of Search ..... 75/238–242, 75/244, 246; 419/33, 11, 13, 16, 18, 41, 57, 60, 23, 36, 38

[56] References Cited

U.S. PATENT DOCUMENTS

| | | | |
|---|---|---|---|
| 3,861,990 | 1/1975 | Kasai et al. | 428/543 |
| 3,986,335 | 10/1976 | Harper | 368/83 |
| 4,113,480 | 9/1978 | Rivers | 75/214 |
| 4,167,850 | 9/1979 | Schneider | 368/282 |
| 4,574,011 | 3/1986 | Bonjour et al. | 75/241 |
| 4,589,917 | 5/1986 | Nagato | 75/238 |
| 4,606,767 | 8/1986 | Nagato | 75/242 |
| 4,721,599 | 1/1988 | Nakamura | 419/23 |
| 4,867,943 | 9/1989 | Kiyota | 419/23 |
| 4,985,070 | 1/1991 | Kitamura et al. | 75/238 |
| 5,015,294 | 5/1991 | Ludwig | 106/268 |
| 5,045,276 | 9/1991 | Kijima | 419/9 |
| 5,108,492 | 4/1992 | Kiyota et al. | 75/246 |
| 5,135,712 | 8/1992 | Kijima et al. | 419/36 |
| 5,141,554 | 8/1992 | Kijima | 75/246 |

FOREIGN PATENT DOCUMENTS

| | | |
|---|---|---|
| 0356131 | 2/1990 | European Pat. Off. . |
| 3427673 | 2/1985 | Germany . |
| 60-194044 | 10/1985 | Japan . |
| 1104702 | 4/1989 | Japan . |
| 2294404 | 12/1990 | Japan . |

*Primary Examiner*—Ngoclan T. Mai

*Attorney, Agent, or Firm*—W. G. Fasse; W. F. Fasse

[57] ABSTRACT

A watch exterior part is formed of cemented carbide or stellite alloy, and has a three-dimensionally curved as-sintered surface or a small hole with an as-sintered interior peripheral surface, or has a three-dimensionally curved polished surface obtained by polishing an as-sintered surface. The watch exterior part is manufactured by a method in which organic binder is milled into a material powder, and a molded body obtained by injection molding is subjected to a binder removing process and then sintered. By the manufacturing method, a watch exterior part formed of cemented carbide or stellite alloy has a high strength and a complicated configuration such as a three-dimensional curved surface and a small hole, without applying secondary machining operations such as discharge operations.

21 Claims, 1 Drawing Sheet

WATCH EXTERIOR PARTS AND MANUFACTURING METHOD THEREOF

CROSS-REFERENCE TO RELATED APPLICATION

This application is related to copending U.S. Ser. No. 07/889,854, filed on May 28, 1992, the disclosure of which is incorporated herein by reference.

BACKGROUND OF THE INVENTION

1. Field of the Invention

The present invention relates to watch exterior parts having complicated shapes and formed of cemented carbide or stellite alloy and further relates to manufacturing methods thereof.

2. Description of the Background Art

Recently, hard materials which are damage resistant and have excellent durability have come into use for watch exterior parts such as watch frames, watch band pieces and the like. Especially, there is a tendency that cemented carbides including WC, TaC, TiC and so forth, or stellite alloys containing Co—Cr—W, for example, are widely used.

Such cemented carbides or stellite alloys have a texture in which hard particles such as carbide, nitride or carbonitride of W, Ta, Ti, Cr, for example, are bonded with metal of the iron group such as Co, Fe, Ni and the like, and are manufactured by conventionally well-known powder metallurgy. That is, they are manufactured by a method of mixing WC powder, TaC powder, Co powder, Ni powder etc. according to a predetermined alloy composition, molding the material powder of mixed alloy composition by pressing the powder, and sintering the obtained molded bodies.

However, since molded bodies are obtained by pressing in the above-described normal powder metallurgy method there have been problems such as limitation of the shapes of manufactured products and dimensional precision, for example. That is, products having shapes that can be formed in one axis direction only can be manufactured by die compaction. Even if the CIP (Cold Isostatic Press) technique capable of forming three-dimensional shapes is used, excellent precision cannot be expected because the products are molded inside rubber molds. Accordingly, watch exterior parts have been conventionally obtained by manufacturing sintered bodies having simple shapes by the normal powder metallurgy method, performing secondary machining operations on the sintered bodies to realize complicated shapes such as various kinds of watch frames and watch band pieces having three dimensional curved surfaces and small holes, and performing surface finishing by polishing in order to improve the decorativeness of portions such as surfaces of exterior parts as needed.

However, because cemented carbide and stellite alloys are extremely difficult to be machined, they can be machined only by grinding with diamond grinding stones or by performing discharge machining as a secondary operation. Particularly, discharge machining operation have been essential in forming three-dimensional curved surfaces on inner surfaces of watch frames and interior surfaces of small holes for provision of stems, and the like. However, if sintered bodies of cemented carbide or stellites alloys are subjected to a discharge process, the corresponding processed surfaces are embrittled over a depth of approximately 5 through 100 μm due to the removal, oxidation or the like of metallic constituents. Such embrittlement decreases the material strength, which is likely to cause minor cracking, chipping or breaking of the processed surface due to external impacts leading to breakage of the entirety of a watch exterior part.

Accordingly, watch exterior parts formed of cemented carbide or alloy corresponding to stellite have been conventionally made with simple shapes to reduce the need for discharge machining operations as much as possible. Alternatively, the thickness of such parts has been designed to be larger than needed in order to maintain the strength of the parts after a discharge operation. Therefore conventional methods have disadvantages such as the limitations of designs of watch frames and watch bands, and the increase in the total weight of a watch, for example.

SUMMARY OF THE INVENTION

It is an object of the present invention to provide watch exterior parts formed of cemented carbide or stellite alloys having complicated shapes such as three-dimensional curved surfaces and small holes and also having a high strength while avoiding the use of secondary machining operations such as discharge operations.

In order to achieve the above-mentioned object, in a method of manufacturing watch exterior parts of the present invention, organic binder is milled together with a material powder of cemented carbide or stellite alloy. The mixed binder and powder is then injection-molded to obtain a molded body in the shape of watch exterior parts having a three-dimensional curved surface or a small hole. Then, the obtained molded body is sintered after removing organic binder from the obtained molded body.

The cemented carbide includes sintered alloy obtained by mixing powder of carbide, carbonitride and/or nitride of at least one element selected from the elements Ti, Zr, Hf, V, Nb, Ta, Cr, Mo, W which belong to the periodic table groups IVa, Va, and VIa and powder of at least one metal selected from the iron group metals Fe, Co, Ni and sintering the same. The stellite alloy includes Co based alloy including Co, Cr, W and C as main components.

A watch exterior part of the present invention manufactured according to the method of the present invention is characterized in that it is formed of a sintered body of cemented carbide or stellite alloy, and has a three-dimensional curved, as-sintered surface or has a small hole with an as-sintered inner surface, or has a three-dimensional curved, polished surface obtained by polishing the as-sintered surface in order to enhance decorativeness.

External parts for a watch having three-dimensional curved surfaces include watch frame pieces and watch band pieces, for example. Small holes of watch exterior parts include band attachment holes, stem attachment holes, band connecting holes, for example.

In the method of the present invention, the injection molding which has been conventionally used in manufacturing plastic products and also recently used in manufacturing ceramics products is applied to the powder metallurgy of cemented carbide or stellite alloy to produce watch exterior parts such as watch frames and watch band pieces having complicated shapes. That is, a molded body having a complicated shape with a three-dimensional curved surface, a small hole or the like whereby the shape is that of a desired watch exterior part is formed using injection molding of a material powder into which an organic binder has been milled. The molded body is subjected to a binder removing process and then sintered to obtain a watch exterior part having a predetermined complicated shape.

As material powder, cemented carbide including, e.g., WC, TaC, TiC or stellite alloy including Co—Cr—W—C, for example, is used. Hard particle powder, for example, including WC powder, TaC powder or TiC powder, and bonded metal powder such as Co powder, Ni powder or Fe powder are appropriately mixed corresponding to the composition of the alloy. The material powder is mixed and pulverized simultaneously in a dry or wet manner using a general ball mill or an Attyritor, a high energy ball mill developed by Attoritor Union Process Inc. If the mixing and pulverizing are insufficient, the sintering characteristics are degraded and a sintered body which is close to true density cannot be obtained. Accordingly, it is preferred that material powder after mixing and pulverizing contains particles with size equal to or smaller than 2 μm by 20 weight % or more.

As an organic binder to be milled into the material powder, binders that have been conventionally used in injection molding of ceramics products can be used. For example, polyethylene, polypropylene, polystyrene, acrylic, ethylene-vinyl acetate, various kinds of wax, paraffin and so forth can be used singly or in combination.

In the binder removing process, the organic binder is melted and flowed out, or decomposed or sublimated by heating the molded bodies in a manner depending on the included type of milled-in organic binder. Since the specific gravity of molded bodies such as thereof cemented carbide is larger than that of ceramics, care must be taken to suppress deformation of the bodies due to their own weight. Also, the atmosphere of the binder removing process is preferably a vacuum, or an atmosphere of non-oxidizing gas such as hydrogen gas, nitrogen gas or an inert gas in order to suppress oxidation of the material powder.

By sintering a molded body that has been subjected to a binder removing process in a vacuum or hydrogen gas, a sintered body having a complicated shape defining a predetermined exterior for a watch can be obtained. The sintering temperature can be the same as that in powder metallurgy using normal pressurizing molding. However, care must be taken because deformations are likely to occur in molded bodies if the sintering temperature is too high, and sintering is preferably performed in a temperature range of approximately +50° C. from a melting point of the metal phase of Ni, Fe or Co, for example.

As described above, in the method of the present invention, molded bodies obtained by injection molding are sintered, and sintered bodies of cemented carbide or stellite alloy can be obtained having complicated shapes with three-dimensional curved surfaces, small holes and the like. Without requiring of secondary machining operations such as a discharge operation, watch exterior parts such as watch frames and watch band pieces and the like having three-dimensional curved as-sintered surfaces or small holes with as-sintered inner peripheral surfaces can be obtained as they are. As desired surface finishing can be performed as usual in order to implement a mirror surface finish or the like by slightly polishing the parts at portions where decorativeness must be enhanced such as surfaces of exterior parts. Accordingly, in the method of the present invention, substantial secondary operations such as discharge operations are not required in order to form configurations of watch exterior parts.

The foregoing and other objects, features, aspects and advantages of the present invention will become more apparent from the following detailed description of the present invention when taken in conjunction with the accompanying drawings.

DETAILED DESCRIPTION OF THE PREFERRED EMBODIMENTS AND OF THE BEST MODE OF THE INVENTION

Embodiments of the present invention will be described below.

In a first embodiment, 88 weight % of WC powder having a mean particle diameter of 1 μm and 12 weight % of Ni powder with a mean particle diameter of 2 μm were pulverized and mixed for 30 hours in ethyl alcohol using a ball mill. After the mixed material to obtain a mixed powder, 5 weight % of paraffin and 2 weight % of polyethylene were added as organic binders and milled for two hours by a kneader. The milled substance was injection-molded into a mold for watch band pieces by an injection molding machine. Next, the molded body was heated to 450° C. by increasing temperature at a rate of 20° C./hour in nitrogen gas and held for one hour to remove the organic binder.

Figure 1:
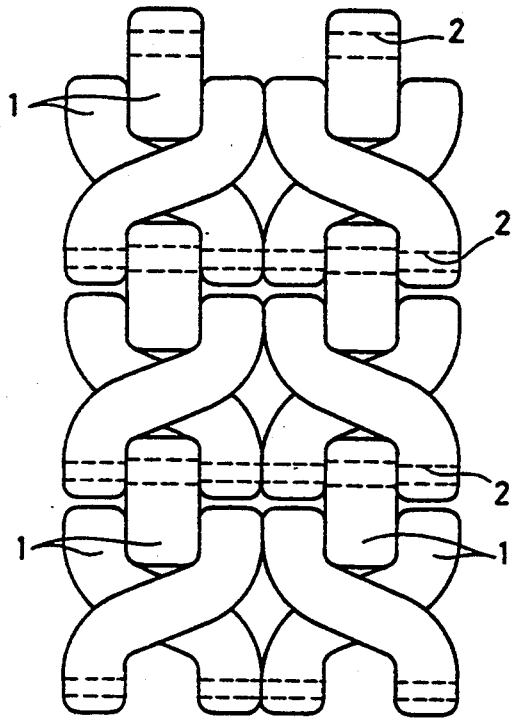
FIG. 1 is a plan view illustrating one specific example of a component piece a watch band according to the present invention.

By sintering the molded body after the binder removing process in a vacuum at 1400° C. for 30 minutes, component pieces 1 for a watch band having three dimensional curved surfaces and two kinds of assembly holes 2 with diameters of 0.8 mm and 1.0 mm as shown in FIG. 1 were manufactured.

By measuring the diameters of the small assembly holes 2 of the watch band pieces 1, it was determined that the precision is ±0.05 mm in hole diameter and ±0.08 mm in hole pitch, which means that sufficient precision in assembly can be obtained without performing a conventional secondary operation such as a discharge operation, and finished products can be manufactured merely be performing mirror surface finishing by removing burrs and then polishing them surfaces.

Furthermore, at least 0.75 mm wall thickness of a small hole has been conventionally necessary for obtainings predetermined strength in watch band pieces in which assembly holes are formed by discharge operation. However, it was discovered that the wall thickness can be made thinner, namely to 0.5 mm according to the present invention, so that the degree of freedom in designing parts increased and it became possible to design parts with small thickness and small weight.

Furthermore, measurements of surface roughness (Rmax) of an as-sintered surface of a watch band component 1 revealed that Rmax of a product manufactured by conventional powder metallurgy using a mold press was 5 μm, but Rmax according to the present invention was 2 μm, which is significantly smoother. It was determined that the number of processes required in polishing steps for surface finishing can be greatly reduced.

Figure 2:
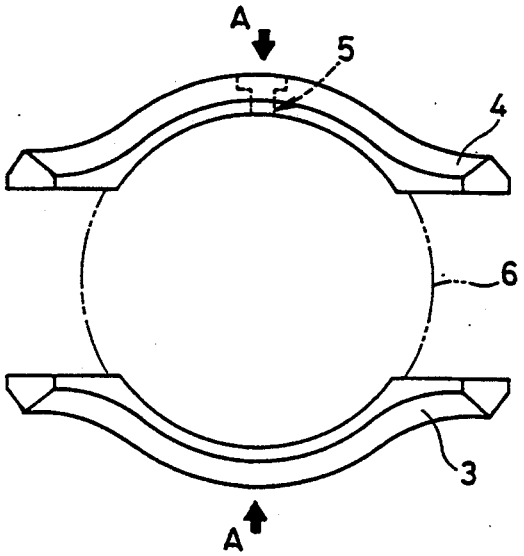
FIG. 2 is a plan view illustrating watch frame pieces which include two in one set as one specific example of a watch frame according to the present invention.

A second embodiment using a method similar to the first embodiment pertains to a watch frame piece 3 to form the nine o'clock side of a watch frame that includes two watch frame pieces. The watch frame piece 3 was formed of cemented carbide with a composition of 88 weight % of WC and 12 weight % of Ni and having a three-dimensional curved surface which is to be fixed to a watch ring 6 such as bezel made of stainless steel as shown in FIG. 2. Also, for comparison, a press molded body of material powder having the same composition as that described above was sintered under the same conditions, and then a comparison watch frame piece 3 having the same configuration was manufactured with a three dimensional curved surface formed by a discharge operation.

Strength tests have been conducted in which a test load is applied in the direction of arrow A—A shown in FIG. 2 to each of four watch frame pieces of the present invention and the comparative example. The measured results of breaking load are shown in table 1.

TABLE 1

| watch frame piece | breaking load (kg) |
|---|---|
| invention | 88, 69, 89, 88 |
| comparative example | 45, 38, 47, 44 |

From table 1, it can be seen that watch frame pieces of the present invention have a strength approximately double that of the watch frame pieces of the comparative example. Also, in the strength tests it was observed that breakage of each frame piece according to the comparative example took place starting at planes subjected to discharge machining.

A third embodiment using a method similar to the first embodiment pertains to a watch frame piece 4 to form the three o'clock side of a watch frame including two watch frame pieces. A ring 6 made of stainless steel is to be attached to the frame piece 4 as shown in FIG. 2. The frame piece 4 has a three-dimensional curved surface and a small hole 5 for provision of a watch stem with a diameter of 1.5 mm. Changing material powders, a watch frame piece **4*a* (indicated generally in FIG. 2 by reference number 4) was formed of cemented carbide with a composition of 70 weight % of Tic 10 weight % of $Mo_2$, and 20 weight % of Ni. A watch frame piece 4*b* (also generally indicated as 4 in FIG. 2) was formed of cemented carbide of 90 weight % of TaC and 10 weight % of Ni. Are watch frame piece 4*c* (also generally indicated 4 in FIG. 2**) a stellite was formed of alloy with a composition of 50 weight % of Co, 40 weight % of CrC, and 10 weight % of W.

For comparison, material powders with compositions the same as each of the above-mentioned watch frame pieces **4*a*, 4*b*, 4*c* were injection-molded to form molded bodies having no small holes 5 for provision of stems, and the molded bodies were sintered under conditions the same as above to form watch frame pieces 4 (having no small hole 5 for provision of stem). Subsequently, small holes 5 were formed by a discharge operation to manufacture each of watch frame pieces 4*d* (including WC—Ni), 4*e* (including TaC—Ni) and 4*f* (stellite alloy) of a comparative example having the same configuration as that of watch frame piece 4 of FIG. 2**.

Strength tests have been conducted to each of the four watch frame pieces of the present invention and on the comparative example. In each test a load was applied in the direction of arrow AA of FIG. 2. The results of measuring the breaking load are shown in table 2.

TABLE 2

| watch frame piece | | breaking load (kg) |
|---|---|---|
| invention | 4a | 52 43 55 49 |
| same | 4b | 40 30 29 28 |
| same | 4c | 63 59 60 54 |
| Comparative example | 4d | 23 20 27 19 |
| same | 4e | 17 22 20 18 |
| same | 4f | 37 31 28 30 |

It was observed that breakage of all watch frame pieces **4*d*–4*f*** of the comparative example took place starting at inner peripheral surfaces of small holes formed by the discharge operation.

According to the embodiments described above, watch exterior parts such as watch frames and watch band pieces having a high strength can be provided according to the invention. The parts have three dimensional curved as-sintered surfaces or polished surfaces, small holes having as-sintered surfaces and the like. The parts are formed of cemented carbide including WC, for example, or stellite alloy.

Furthermore, there is no need to perform secondary machining operations such discharge operations, and the as-sintered surfaces are smooth, so that finish working or machining steps can be greatly simplified as compared to conventional cases. Furthermore, since high strength can be achieved even in parts with a small thickness, it is possible according to the present invention to greatly improve and modify the design of watch exterior parts.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A watch exterior part formed of sintered alloy comprising a Co based alloy containing Co, Cr, W and C as main components, obtained by forming a milled powder mixture by milling together powders selected from the group consisting of carbides, carbonitrides and nitrides of at least one element selected from the group consisting of Ti, Zr, Hf, V, Nb, Ta, Cr, Mo, and W, and a metal powder selected from the iron group metals consisting of Fe, Co, and Ni, and sintering said milled powder mixture to form said part, wherein said part has a three-dimensionally curved, as-sintered surface.

2. The watch exterior part according to claim 1, wherein said Co based alloy is a stellite alloy.

3. A watch exterior part formed of sintered alloy comprising a Co based alloy containing Co, Cr, W and C as main components, obtained by forming a milled powder mixture by milling together powders selected from the group consisting of carbides, carbonitrides and nitrides of at least one element selected from the group consisting of Ti, Zr, Hf, V, Nb, Ta, Cr, Mo, and W, and a metal powder selected from the iron group metals consisting of Fe, Co, and Ni, and sintering said milled powder mixture to form said part, wherein said part has a three-dimensionally curved, polished surface obtained by polishing an as-sintered surface.

4. The watch exterior part according to claim 3, wherein said Co based alloy is a stellite alloy.

5. A watch exterior part formed of sintered alloy comprising a Co based alloy containing Co, Cr, W and C as main components, obtained by forming a milled powder mixture by milling together powders selected from the group consisting of carbides, carbonitrides and nitrides of at least one element selected from the group consisting of Ti, Zr, Hf, V, Nb, Ta, Cr, Mo, and W, and a metal powder selected from the iron group metals consisting of Fe, Co, and Ni, and sintering said milled powder mixture to form said part, wherein said part has a small hole with an as-sintered inner peripheral surface.

6. The watch exterior part according to claim 5, wherein said Co based alloy is a stellite alloy.

7. A method of manufacturing a watch exterior part, comprising the following steps:

(a) milling a material powder comprising a Co based alloy containing Co, Cr, W and C as main components and an organic binder;

(b) injection-molding said milled material powder and organic binder to form a molded body having a configuration of said watch exterior part having a feature selected from the group consisting of a three-dimensionally curved surface and a small hole;

(c) removing said organic binder from said molded body injection-molded in said step (b); and (d) sintering said molded body after said step (c) of removing said organic binder.

8. The method of manufacturing a watch exterior part according to claim 7, further comprising a step of forming said material powder by milling together powders selected from the group consisting of carbides, carbonitrides and nitrides of at least one element selected from the group consisting of the elements Ti, Zr, Hf, V, Nb, Ta, Cr, Mo, and W and a metal powder selected from the iron group metals consisting of Fe, Co, and Ni.

9. The method of manufacturing a watch exterior part according to claim 7, wherein said material powder contains particles with particle size of 2 μm or smaller in a proportion of 20 weight % or more.

10. The method of manufacturing a watch exterior part according to claim 7, wherein said binder removing step (c) includes a step of heating said molded body in an environment selected from the group consisting of a vacuum and a non-oxidizing gas atmosphere.

11. The method of manufacturing a watch exterior part according to claim 7, wherein said sintering step (d) is performed at a temperature ranging from a melting point of a metal phase of said material powder to a temperature 50° C. higher than said melting point.

12. The method of manufacturing a watch exterior part according to claim 7, wherein said Co based alloy is a stellite alloy.

13. A method of manufacturing a watch exterior part, comprising the following steps:

(a) milling a material powder containing particles with particle size of 2 μm or smaller in a proportion of 20 weight % or more and an organic binder;

(b) injection-molding said milled material powder and organic binder to form a molded body having a configuration of said watch exterior part having a feature selected from the group consisting of a three-dimensionally curved surface and a small hole;

(c) removing said organic binder from said molded body injection-molded in said step (b); and (d) sintering said molded body after said step (c) of removing said organic binder.

14. The method of manufacturing a watch exterior part according to claim 13, further comprising a step of forming said material powder by milling together powders selected from the group consisting of carbides, carbonitrides and nitrides of at least one element selected from the group consisting of the elements Ti, Zr, Hf, V, Nb, Ta, Cr, Mo, and W and a metal powder selected from the iron group metals consisting of Fe, Co, and Ni.

15. The method of manufacturing a watch exterior part according to claim 13, wherein said binder removing step (c) includes a step of heating said molded body in an environment selected from the group consisting of a vacuum and a non-oxidizing gas atmosphere.

16. The method of manufacturing a watch exterior part according to claim 14, wherein said sintering step (d) is performed at a temperature ranging from a melting point of a metal phase of said material powder to a temperature 50° C. higher than said melting point.

17. The method of manufacturing a watch exterior part according to claim 13, wherein said material powder comprises a stellite alloy.

18. A method of manufacturing a watch exterior part, comprising the following steps:

(a) milling a material powder including a metal phase and an organic binder;

(b) injection-molding said milled material powder and organic binder to form a molded body having a configuration of said watch exterior part having a feature selected from the group consisting of a three-dimensionally curved surface and a small hole;

(c) removing said organic binder from said molded body injection-molded in said step (b); and (d) after said step (c) of removing said organic binder, sintering said molded body at a temperature ranging from a melting point of said metal phase of said material powder to a temperature 50° C. higher than said melting point.

19. The method of manufacturing a watch exterior part according to claim 18, further comprising a step of forming said material powder by milling together powders selected from the group consisting of carbides, carbonitrides and nitrides of at least one element selected from the group consisting of the elements Ti, Zr, Hf, V, Nb, Ta, Cr, Mo, and W and a metal powder selected from the iron group metals consisting of Fe, Co, and Ni.

20. The method of manufacturing a watch exterior part according to claim 18, wherein said binder removing step (c) includes a step of heating said molded body in an environment selected from the group consisting of a vacuum and a non-oxidizing gas atmosphere.

21. The method of manufacturing a watch exterior part according to claim 18, wherein said material powder comprises a stellite alloy.

* * * * *

UNITED STATES PATENT AND TRADEMARK OFFICE

CERTIFICATE OF CORRECTION

PATENT NO. : 5,403,374

DATED : April 4, 1995

INVENTOR(S) : Kitagawa et al.

It is certified that error appears in the above-identified patent and that said Letters Patent is hereby corrected as shown below:

Col. 2, line 4, after "impacts" insert --,--;
line 21, after "holes" insert --,--.

Col. 3, line 35, replace "thereof" by --those of--;
line 65, after "desired" insert --,--.

Col. 5, line 10, after "as" insert --a--;
line 46, after "Tic" insert --,--;
line 47, replace "$Mo_2$," by --$Mo_2C$,--;
line 50, replace "Are" by --A--;
line 51, replace "a stellite was formed of" by --was formed of stellite--;
line 66, replace "to" by --on--.

Col. 6, line 1, replace "AA" by --A-A--;
line 27, after "such" insert --as--.

Signed and Sealed this

Fourth Day of July, 1995

Bruce Lehman

*Attest:*

BRUCE LEHMAN

*Attesting Officer*

*Commissioner of Patents and Trademarks*